US005423421A

United States Patent [19]

Inoue et al.

[11] Patent Number: 5,423,421

[45] Date of Patent: * Jun. 13, 1995

[54] CONTAINERS HAVING PLURALITY OF CHAMBERS

[75] Inventors: Fujio Inoue; Masamitsu Izumi; Shigetoshi Kashiyama, all of Naruto, Japan

[73] Assignee: Otsuka Pharmaceutical Factory, Inc., Naruto, Japan

[ * ] Notice: The portion of the term of this patent subsequent to Dec. 7, 2010 has been disclaimed.

[21] Appl. No.: 170,215

[22] PCT Filed: Apr. 28, 1993

[86] PCT No.: PCT/JP93/00558

§ 371 Date: Dec. 28, 1993

§ 102(e) Date: Dec. 28, 1993

[87] PCT Pub. No.: WO93/21890

PCT Pub. Date: Nov. 11, 1993

[30] Foreign Application Priority Data

May 3, 1992 [JP] Japan ..... 4-140113
Feb. 28, 1993 [JP] Japan ..... 5-064669

[51] Int. Cl.[6] ..... B65D 81/32
[52] U.S. Cl. ..... 206/219; 604/416
[58] Field of Search ..... 206/204, 205, 213.1, 206/219, 568; 604/410, 416

[56] References Cited

U.S. PATENT DOCUMENTS

| | | | |
|---|---|---|---|
| 3,847,279 | 11/1974 | Montgomery | 206/219 |
| 4,458,811 | 7/1984 | Wilkinson | 206/219 |
| 4,462,224 | 7/1984 | Dunshee et al. | 62/530 |
| 4,496,046 | 1/1985 | Stone et al. | 206/219 |
| 4,602,910 | 7/1986 | Larkin | 604/416 |
| 4,608,043 | 8/1986 | Larkin | 604/87 |
| 4,731,053 | 3/1988 | Hoffman | 206/221 |
| 4,770,295 | 9/1988 | Carveth et al. | 206/219 |
| 4,961,495 | 10/1990 | Yoshida et al. | 206/219 |
| 5,114,004 | 5/1992 | Isono et al. | 206/222 |
| 5,176,634 | 1/1993 | Smith et al. | 206/219 |
| 5,267,646 | 12/1993 | Inoue et al. | 206/219 |

FOREIGN PATENT DOCUMENTS

| | | |
|---|---|---|
| 0067420 | 12/1982 | European Pat. Off. . |
| 0109983 | 6/1984 | European Pat. Off. . |
| 0263571 | 4/1988 | European Pat. Off. . |
| 0513364 | 11/1992 | European Pat. Off. . |
| 1486639 | 11/1969 | Germany . |
| 34 26 465.5 | 1/1986 | Germany . |
| 576008 | 4/1958 | Italy . |
| 59-126974 | 8/1984 | Japan . |
| 63-309263 | 12/1988 | Japan . |
| 1-240469 | 9/1989 | Japan . |
| 3-236847 | 10/1991 | Japan . |
| WO88/08694 | 11/1988 | WIPO . |

*Primary Examiner*—Jimmy G. Foster
*Attorney, Agent, or Firm*—Armstrong, Westerman, Hattori, McLeland & Naughton

[57] ABSTRACT

A container having a plurality of chambers chiefly for use in the field of medicine. The body of the container is made of flexible plastics and has partition means dividing the container body into the chambers and permitting communication between the chambers when required. At least one of the chambers is enclosed with a cover to form a closed space therein around the chamber. The cover is made of a flexible film having barrier properties against moisture and gas. The container is inexpensive, has high quality and is efficient to use and easy to dispose of.

11 Claims, 6 Drawing Sheets

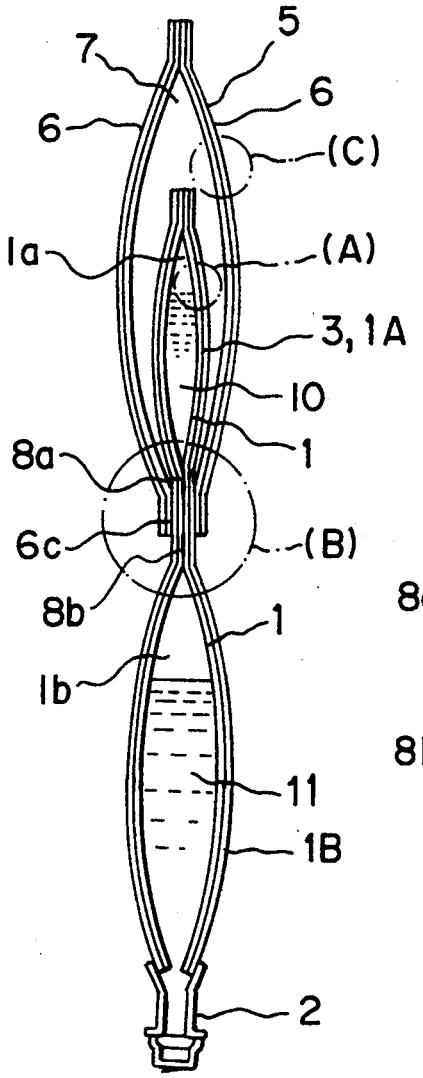
FIG. 1
FIG. 2
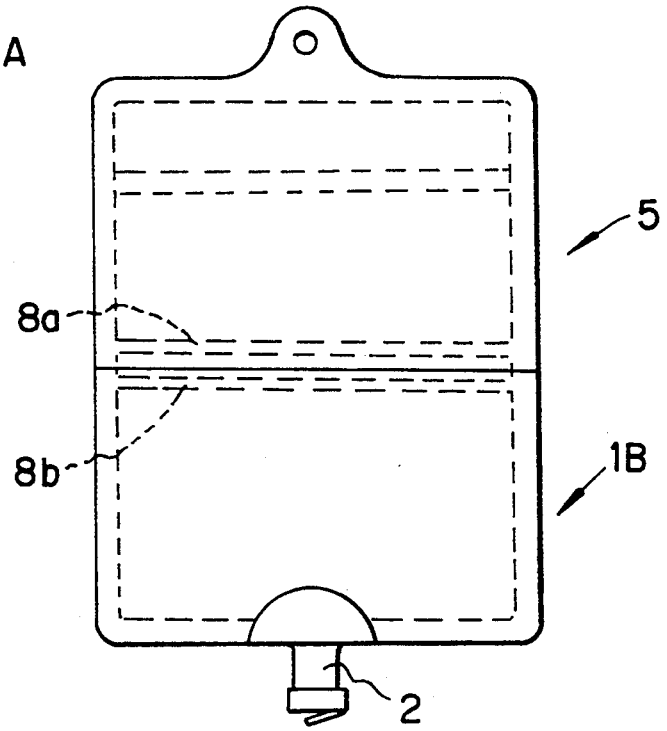
FIG. 3
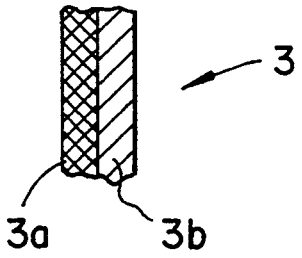

2a
3
2
1
36
35
8b
9
8a
1A
11
18
10
1A1
1B
40
5
6b
1a

CONTAINERS HAVING PLURALITY OF CHAMBERS

TECHNICAL FIELD

The present invention relates to containers having a plurality of chambers chiefly for use in the field of medicine, and more particularly to flexible containers of plastics having a plurality of chambers for accommodating liquid preparations, powder preparations or solid preparations, and partition means dividing the container into the chambers and permitting communication between the chambers when required.

BACKGROUND ART

Flexible containers of plastics have heretofore been used in the field of medicine which have a plurality of chambers, and partition means dividing the container into the chambers and permitting communication between the chambers. Since such a container is likely to permit penetration of moisture or gas even if in a very small amount, there arises a need to place the container, along with a desiccant, into an expensive outer bag having barrier properties against moisture and gas when the container is used for separately preserving an antibiotic or like medicinal which is hygroscopic and becomes unstable with time, and a liquid preparation such as physiological saline, glucose or like solution or dilution. Nevertheless, the desiccant, which absorbs water from the liquid preparation, fails to fully dry up the hygroscopic medicinal and further causes concentration of the liquid preparation. Because of this drawback, it has not been practice to preserve the hygroscopic and unstable antibiotic or like medicinal and the liquid preparation as separately accommodated in the flexible container of plastics.

For this reason, medicinals, such as antibiotics, which become unstable with time are preserved in moisture- and gas-impermeable vials or like containers before use. When to be administered to the patient, the medicinal is mixed or diluted with, or dissolved in, physiological saline, glucose solution or like dissolving liquid or diluent which is preserved separately.

However, this method is cumbersome to practice and involves the hazard of contamination with bacteria during the handling procedure. Containers have therefore been developed which comprise a glass vial having enclosed therein an unstable antibiotic and a dissolving liquid-containing flexible container portion of plastics joined to the vial in combination therewith, with a piercing needle provided therebetween (see, for example, Unexamined Japanese Patent Publication HEI 2-1277). These containers have the advantage that the contents can be mixed together with ease aseptically, whereas difficulties are encountered in discarding the container because a very complicated procedure is needed for separating the container into the glass vial, flexible container portion and piercing implement for disposal. Thus, the container has a problem as the disposal of medical wastes which has attracted attention presently, i.e., the problem of failing to fulfill the requirement of easy disposal.

Also known are containers having a plurality of chambers for accommodating other medicinal which is readily oxidizable, such as amino acid solution containing tryptophan, and a sugar or electrolytic solution (see, for example, Examined Japanese Patent Publication SHO 63-20550). The container of this type must be preserved as placed in an expensive moisture- and gas-barrier outer bag together with an oxygen absorber. In this case, the latter preparation (sugar or electrolyte solution) on which the absorber need not act is also accommodated in the outer bag along with the medicinal. The outer bag therefore requires a larger capacity, an oxygen absorber having an increased capacity to absorb oxygen or an increased amount of absorber, and a larger amount of moisture- and gas-barrier material, hence the drawback of an increased cost.

DISCLOSURE OF THE INVENTION

An object of the present invention is to provide a flexible container of plastics having a plurality of chambers and usable for accommodating and preserving liquid preparations, powder preparations or solid preparations which are hygroscopic or susceptible to oxidation.

Another object of the present invention is to provide such a container which can be prepared with use of a reduced amount of expensive moisture- and gas-barrier film and which is therefore inexpensive.

Still another object of the present invention is to provide a container of the type mentioned which need not include a glass vial and which is therefore easy to dispose of.

Another object of the present invention is to provide such a container wherein at least one of the chambers contains a liquid, powder or solid medicinal preparation which is hygroscopic or susceptible to oxidation, only this chamber being separated from outside moisture and oxygen and adapted to prevent the preparation from oxidation or absorbing moisture without enclosing any oxygen absorber nor desiccant therein.

Other features of the present invention will become apparent from the following description.

The present invention provides a container having a plurality of chambers for accommodating a liquid, powder or solid and partition means dividing the container into the chambers and permitting communication between the chambers when required, the container being characterized in that the container comprises a flexible plastics container body forming the plurality of chambers, at least one of the chambers being enclosed with a cover having a sealed periphery to form a closed space therein around the chamber, the other chamber or chambers being coverless, the cover being made of a flexible film having moisture- and gas-barrier properties, the partition means being formed by at least one weak seal portion easily openable by pressing the chamber to give an increased internal pressure.

With the container of the present invention, a usual substance, such as a liquid, powder or solid preparation which is not susceptible to oxidation or hygroscopic, is accommodated in the coverless chamber among the chambers of the container. This chamber is not enclosed with a moisture- and gas-impermeable cover and is therefore low in moisture- and gas-barrier properties, whereas the substance contained therein can be preserved for a long period of time as in common plastics containers since the substance is a usual one.

On the other hand, a special substance, such as a liquid, powder or solid preparation which is susceptible to oxidation and/or hygroscopic, is accommodated in the chamber enclosed with the cover. The container body forming the chamber is made of plastics, has moisture- and gas-permeability inherent to plastics although very slight and is low in moisture- and gas-barrier properties. However, the cover enclosing the chamber is made of a special film which is impermeable to moisture and gas, so that the special substance can be preserved for a long period of time free of degradation despite the low moisture- and gas-barrier properties of the plastics container body.

Accordingly, although made of flexible plastics, the container of the present invention is usable free of any trouble for accommodating medicinals, such as antibiotics, which are hygroscopic and become unstable with time, and liquid preparations such as dissolving solutions or diluents.

The container of the present invention has the gas-impermeable cover of expensive special film, whereas the cover is provided on the container only locally and can therefore be formed with use of a small amount of the expensive special film. This serves to minimize the rise in the cost of packaging. A further cost reduction can be achieved since there is no need to enclose an oxygen absorber or desiccant in the cover around the container body.

The plurality of chambers of the container of the invention are separated by at least one weak seal portion, which can be opened by a pressure applied from outside to cause the chambers to communicate with each other. Medicinal components can therefore be mixed together aseptically while being held out of contact with outside air. The plastics container body and the cover constituting the container are both flexible and readily deformable, so that the container can be disposed of without the necessity of separation more easily than containers wherein glass or metal is used.

BRIEF DESCRIPTION OF THE DRAWINGS

FIG. 1 is an enlarged view in vertical section showing the container according to an embodiment of the invention;

FIG. 2 is a front view of the same;

FIG. 3 is an enlarged sectional view of the portion A in FIG. 1;

BEST MODE OF CARRYING OUT THE INVENTION

Embodiments of the present invention will be described below with reference to the accompanying drawings.

FIGS. 1 and 2 show an embodiment of the invention of the type having two weak seal portions.

Referring to FIG. 1 showing the embodiment, indicated at 1 is a flexible plastics container body which has a discharge port 2.

The plastics container body 1 is prepared from two superposed sheets of flexible plastics film 3 by heat seal the sheets together along the outer peripheral edges thereof.

The film 3 is not a special one but is an inexpensive plastics film which is generally used for making flexible plastics containers in the field of medicine.

FIG. 3 shows an example of film 3 comprising two layers, i.e., an outer layer 3*a* of polyethylene (hereinafter referred to simply as "PE"), and an inner layer 3*b* of a blend of PE and polypropylene (hereinafter referred to simply as "PP").

As seen in FIG. 1, the plastics container body 1 has two weak seal portions 8*a*, 8*b* extending transversely of the container at an intermediate portion of its height and formed by heat sealing.

The weak seal portions 8*a*, 8*b* are so adapted that the opposed sheets of film can be separated from each other when required by utilizing the internal pressure of the container which is increased as by pressing the container. The seal strength of the weak seal portions must be smaller than that of the peripheral edge portion of the container body 1.

The interior of the plastics container body 1 is divided into upper and lower two chambers 1*a*, 1*b* by the weak seal portions 8*a*, 8*b*. The upper container portion 1A forming the upper chamber la is enclosed with a cover 5, while the lower container portion 1B forming the lower chamber 1*b* is not provided with such a cover 5.

Figure 5:
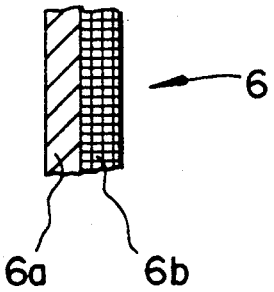
FIG. 5 is an enlarged sectional view of the portion C in FIG. 1.
Figure 6C:
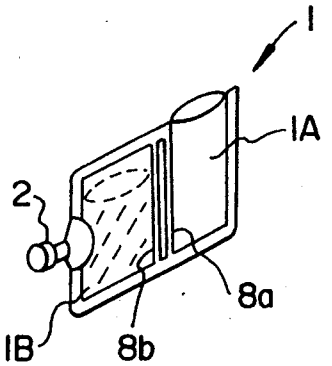
FIGS. 6 (*a–e*) is a diagram illustrating stepwise a preferred example of process for producing the container of the invention shown in FIG. 1.
Figure 6B:
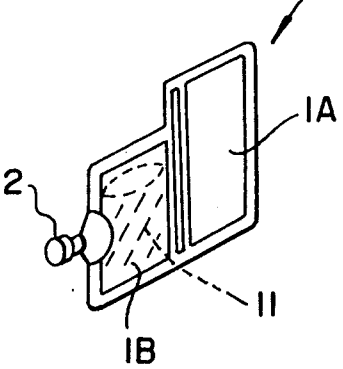
Figure 6A:
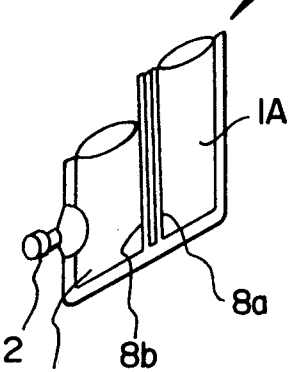
Figure 6E:
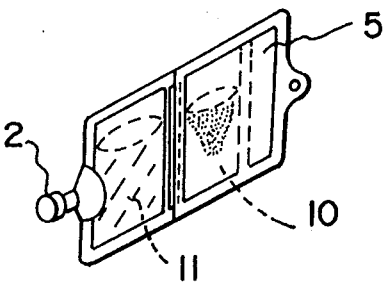
Figure 6D:
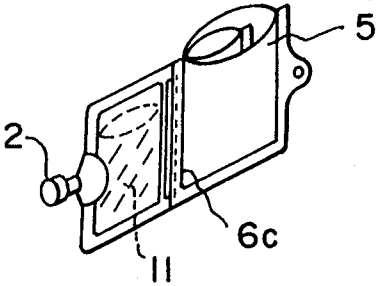

The cover 5 is made of a special film 6 which is impermeable to moisture and gas. FIG. 5 shows an example of special film 6, i.e., a multi-layer film comprising an outer layer 6*a* and an inner layer 6*b* of PE. The outer layer 6*a* is an aluminum-covered film such as aluminum-laminated film, an aluminum-deposited film having high moisture- and gas-impermeability or a two-layer film composed of polyvinylidene chloride and polypropylene (PP). The polyvinylidene chloride forming the outer layer 6*a* may be replaced by a silica-deposited film of polyvinyl alcohol.

With reference to FIG. 1, the cover 5 comprises two sheets of special film 6 which are so arranged as to surround the upper container portion 1A. Of the peripheral portions of the sheets of film 6, the parts which are out of contact with the upper container portion 1A are heat sealed to each other, while the parts in contact with the portion 1A are heat sealed to the outer surface of the portion 1A as indicated at 6*c*, 6*c*. As seen in FIG. 1, the bonded lower edge portions 6*c*, 6*c* are positioned between the weak seal portions 8*a*, 8*b*.

Figure 4:
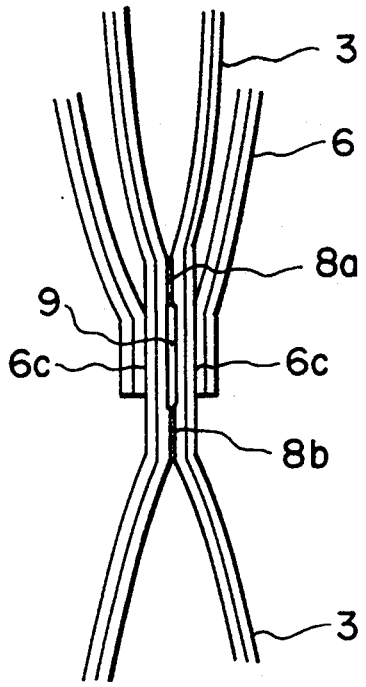
FIG. 4 is an enlarged sectional view of the portion B in FIG. 1.

A space portion 9 is provided between the seal portions 8*a*, 8*b* which is substantially unsealed. FIG. 4 shows the heat sealed joint on an enlarged scale. The lower edge portion 6*c* of the cover 5 is heat sealed to the space portion 9 between the seal portions 8*a*, 8*b*. This obviates the likelihood that the heat sealing operation will give an increased seal strength to the weak seal portions 8*a*, 8*b*. In the case of the single seal portion type, the lower edge portion of the cover 5 is heat sealed to the container body 1 over the weak seal portion. Accordingly, it is desired to seal the edge portion under such a condition that the seal strength of the weak seal portion is prevented from increasing to the greatest possible extent, or the seal portion can be easily separated free of trouble even if the seal strength is increased. Such a condition can be determined by suitably selecting the material for the cover and determining the heat sealing conditions as to temperature, time and pressure, whereas this involves considerable limitations. In the case of the present embodiment shown in FIGS. 1 and 4, the lower edge portion 6*c* of the cover 5 can be sealed to the container body 1 without adversely affecting the seal strength of the weak seal portions 8*a*, 8*b*. This leads to the advantage that the material for the cover 5 and the sealing conditions are selectable with greater freedom than in the case of the single seal portion. Further with the present embodiment wherein the lower edge portion 6*c* of the cover 5 is sealed to the space portion 9 between the two weak seal portions 8*a*, 8*b*, the sealed joint of the lower edge portion 6*c* is positioned at a greater distance from the chambers 1*a*, 1*b* of the container body as will be apparent from FIG. 4. This eliminates the likelihood that the heat of the sealing operation will thermally degrade the medicinal preparations accommodated in the chambers 1*a*, 1*b*. Medicinal preparations which are hygroscopic or susceptible to oxidation include many that are susceptible to thermal degradation, whereas the cover 5 lower edge portion can be heat sealed to the container body without the likelihood of thermally degrading such a preparation. Even if one of the two weak seal portions is opened, the other portion prevents the two chambers from communicating with each other.

For example, a powder preparation 10 which is hygroscopic and/or susceptible to oxidation is accommodated within the covered upper container portion 1A, while a usual liquid preparation 11, for example, is accommodated within the coverless lower container portion 1B.

The temperature at which the seals are formed is the highest for the entire peripheral portion of the plastics container body 1 and the upper edge portion and side edge portions of the cover 5, less high for the lower edge portions of the cover 5 sealed to the container body 1, and lowest for the weak seal portions 8*a*, 8*b*. Consequently, the weak seal portions 8*a*, 8*b* are the lowest of all the seals in bond strength.

FIG. 6 shows a preferred example of process for producing the present container shown in FIGS. 1 and 2. The process will be described below with reference to FIGS. 6, (*a*) to (*e*).

First as shown in FIG. 6, (*a*), two sheets of plastics film shown in FIG. 3 are placed over each other so that the inner layers 3*b*, 3*b* are brought into contact with each other, and three sides of the assembly are heat-sealed at a temperature about 170° to about 200° C. to make a plastics container body 1. Next, weak seal portions 8*a*, 8*b* are formed at an intermediate portion of the container body at a temperature about 110° to about 130° C., and a discharge port 2 is attached to the body. Consequently formed are an upper container portion 1A providing an upper chamber, and a lower container portion 1B separated from the portion 1A and providing a lower chamber.

Subsequently, a liquid preparation 11 is filled into the lower container portion 1B through the unsealed part thereof. As seen in FIG. 6, (*b*), the unsealed parts of the two container portions 1A, 1B are sealed, followed by heating for sterilization with use of high-pressure steam, hot water or the like.

Thereafter, one side of the upper container portion 1A is then cut in an aseptic atmosphere as seen in FIG. 6, (*c*) to open this portion, which is thereafter dried when so required.

Next as shown in FIG. 6, (*d*), a cover 5 is provided over the upper container portion 1A using the special film shown in FIG. 5 and is heat-sealed on its three sides. The lower edge portions 6*c* extending along the weak seal portions 8*a*, 8*b* are heat-sealed at a temperature about 130° to 135° C. at an intermediate area between the two portions 8*a*, 8*b* to avoid heat-sealing of the lower edge portions as superimposed on the weak seal portions. One side of the cover 5 corresponding to the open side of the upper container portion 1A is similarly left open.

Finally, a powder preparation 10, such as antibiotics, is accommodated in the upper container portion 1A in an aseptic atmosphere, and the portion 1A and the cover 5 are thereafter sealed at the open side. FIG. 6 (*e*) shows the container thus obtained and having the two chambers.

It is desired to replace the air in the space by $N_2$ before the opening is sealed for the removal of oxygen. The weak seal portions can be formed, for example, by pressing a heated seal forming die against the container body by a cylinder device. The die can be of a structure having two ridges spaced apart by a predetermined distance and heatable to a controlled temperature by an electric heater.

A liquid preparation can be placed into the covered container portion 1A and a liquid or powder preparation into the coverless container portion 1B, for example, by a process similar to the foregoing exemplary process. The container accommodating these preparations can be prepared by attaching a discharge port 2 to the container body, then placing the specified preparations into the respective container portions 1A, 1B, closing the filling openings, sterilizing the contents by autoclave, then attaching a cover 5 to the upper container portion 1A, and thereafter sealing the side opening of the cover.

With the containers of the present invention prepared by the processes shown in FIG. 6, the upper container portion 1A is formed by a plastics film comprising an outer layer of PE and an inner layer of blend of PE and PP, so that the container portion 1A permits passage of moisture and gas (e.g. oxygen) although in a very small amount. However, the upper container portion 1A is provided with the cover 5 of special film having moisture- and gas-barrier properties, with the result that the cover 5 functions to overcome the above disadvantage of the upper container portion 1A. Accordingly, a powder preparation which is hygroscopic and/or susceptible to oxidation can be preserved for a long period of time as accommodated in the upper container portion 1A although this portion is formed by plastics. The weak seal portions 8*a*, 8*b* separating the upper and lower container portions 1A, 1B are the lowest in seal strength of all the seals. Therefore, when the container portion is pressed to increase the internal pressure of the container portion, the increased pressure separates the weak seal portions 8*a*, 8*b* permitting the two container portions 1A, 1B to communicate with each other, whereby the liquid preparation and the powder preparation within the respective container portions 1A, 1B can be mixed together under an aseptic condition into a solution as contemplated.

Examples of powder preparations for use in the above embodiment are antibiotic, anti-cancer, steroid, antithrombotic, fibrinolytic, vitamin and like preparations which are hygroscopic and susceptible to oxidation and to thermal degradation. Examples of useful liquid preparations are physiological saline, glucose solution and like dissolving solutions or diluents.

While the usual film for making the plastics container body is a multi-layer film of the construction shown in FIG. 3, also usable is a single-layer or multi-layer film prepared from at least one combination of resins selected from among PE, PP and blends of these resins.

Figure 7:
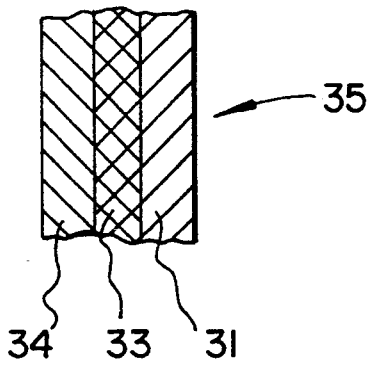
FIG. 7 is a sectional view of a part of the plastics container body of the container according to another embodiment of the invention.

FIG. 7 shows as an example a three-layer film 35 which comprises an outer layer 31 of linear low-density polyethylene (hereinafter referred to briefly as "LLDPE"), an intermediate layer 33 of resin mixture of LLDPE and low-crystalline (or amorphous) ethylene/α-olefin elastomer, and an inner layer 34 of resin mixture of LLDPE and PP.

Further depending on the type of medicinal preparation to be enclosed, low-molecular weight substances contained in the LLDPE present in the inner layer of the inner wall are likely to undergo an inter-action with the preparation with lapse of time, possibly producing a reaction product which would adversely affect the patient. Accordingly, the LLDPE to be used for the inner layer 34 is pretreated at a high temperature in a vacuum as by the devolatilization and stripping process to thereby reduce the content of low-molecular-weight substances with up to about 30 carbon atoms to not higher than a specified value, whereby the interaction between the medicinal preparation and the inner-layer can be prevented favorably.

Further when a suitable amount of high-density polyethylene (HDPE) is incorporated into each layer of the three-layer film 35 as required for giving improved heat resistance to the film, containers can be formed with high stability to withstand sterilization at a high temperature of at least 121° C., for example, with use of high-pressure steam or hot water.

As special films for the cover, it is possible to use single-layer or multi-layer sheets of polyvinylidene chloride, polyethylene terephthalate (PET), aluminum-covered film, ethylene-vinyl alcohol copolymer (EVOH) or silica-deposited film. Preferably, a silica-deposited film is used to form at least a layer of the sheet because of its transparency and high impermeability to moisture and gas.

Figure 8:
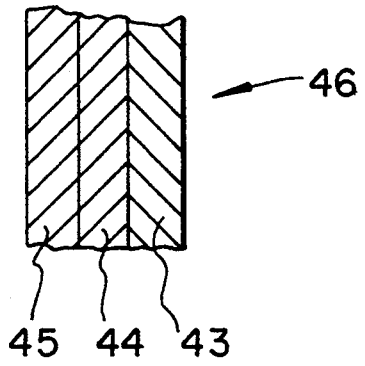
FIG. 8 is a sectional view of a part of the cover of the container according to another embodiment of the invention.

FIG. 8 shows a moisture- and gas-impermeable barrier film as an example of such film, i.e., a three-layer film 46 which comprises an outer layer 43 of biaxially oriented PET film, an intermediate layer 44 of silica-deposited PVA film and an inner layer 45 of low-density polyethylene (LDPE) and in which these layers are bonded to one another with a urethane adhesive resin. When the cover is to be heat sealed directly to the plastics container body, it is desirable to use a multi-layer film at least for the cover so that the material of the innermost layer of the cover is the same as the material of the outermost layer of the plastics container body, whereby a satisfactory heat seal can be formed. For example, when the outermost layer of the container body is LLDPE, it is desirable to use LLDPE for the innermost layer of the cover.

Although a powder preparation is enclosed in the chamber of the covered container portion and a liquid in the chamber of the coverless container portion according to the foregoing embodiment, the powder preparation and the liquid preparation can be replaced by each other depending on the contemplated purpose.

A liquid preparation is accommodated in the covered container portion with a powder preparation enclosed in the other container portion, for example, in the case where the liquid preparation is an amino acid preparation or the like containing cysteine or tryptophan added thereto and susceptible to oxidation, and the powder preparation is a sugar, an electrolyte or a mixture thereof.

A liquid preparation is enclosed in the covered container portion with other liquid preparation in the other container portion, for example, in the case where the former liquid preparation is susceptible to oxidation, such as an amino acid preparation containing cysteine or tryptophan, or a vitamin preparation, and the latter liquid preparation is a sugar or electrolytic preparation.

Another example is such that the former liquid preparation is a readily oxidizable fat emulsion or the like, and the latter preparation is a sugar or electrolytic preparation.

Further it is possible to enclose a solid preparation in one of the container portions and a liquid preparation in the other container portion. Other examples of such powder, liquid and solid preparations are various nutrient preparations and curing agents which are given intravenously or enterally (tube or oral feeding).

Further cover may be made locally or entirely of an aluminum-covered film to shield the interior from light. The aluminum-covered film used for the cover may be made peelable locally or entirely when the preparation is to be used, if so desired.

Figure 9:
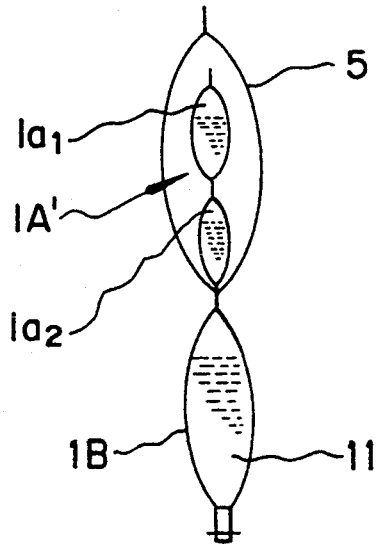
FIG. 9 shows a vertical section of the container according to a further embodiment of the invention.

While the foregoing embodiment is a container having two chambers for accommodating a liquid preparation and one kind of powder preparation individually, such a container can be provided with more than two chambers, for example, as shown in FIG. 9. Disposed inside the cover 5 is a container portion 1A' having chambers $1a_1$, $1a_2$ for accommodating two kinds of powder preparations (or a powder preparation and a solid preparation). A liquid preparation is accommodated in the coverless container portion 1B. It is possible to provide a plurality of chambers for liquid preparations besides powder or solid preparations. Weak seal portions are provided between these chambers.

In the case where a liquid, powder or solid preparation susceptible to oxidation is enclosed in the covered chambers 1a, it is desired to enclosed an inert gas, such as nitrogen gas, carbon dioxide gas or argon gas, in the space inside the cover 5 around the container body 1. When a liquid, powder or solid preparation which is hygroscopic is enclosed in the chambers 1a, it is desired to enclose dry air, dry nitrogen gas or like dry gas in the space. When the inert gas is enclosed, the air in the space is replaced by the inert gas. This ensures a greater effect to prevent oxidation. When the dry gas is enclosed, the air in the space is replaced by the dry gas, which therefore assures an enhanced moistureproof effect.

The medicinal preparations contained in the container can be given high stability despite the lapse of time by the moisture- and gas-impermeable film covering the chamber or chambers which must be moisture-proof and free of oxidation, and further by enclosing the inert gas or dry gas in the space inside the cover around the container body, without placing an oxygen absorber and/or desiccant into the space unlike the conventional practice.

Two weak seal portions need not always be formed, but more than two seal portions or a single seal portion can be provided. Further the weak seal portion need not always be linear but can be V-shaped so as to project approximately toward the center of the covered chamber. When a pressure is applied to one chamber with hand in this case, the force acting to open the weak seal portion will concentrate on the V-shaped portion, with the result that the medicinal components can be mixed together by opening the weak seal portion with a relatively small pressure. In this case, however, there is a likelihood that separation will inadvertently occur in the seal portion during storage or transport of the container, so that it is desirable to carefully determine the heat-sealing condition.

Figure 10:
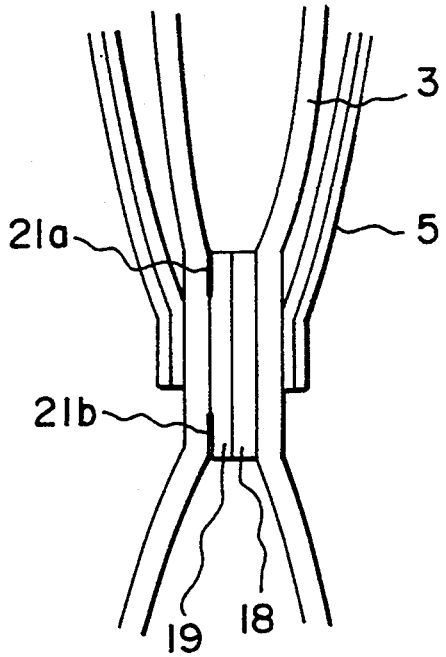
FIG. 10 is an enlarged sectional view of another example of the weak seal portion.

With the foregoing embodiment, the weak seal portion is formed by directly bonding together the inner layers of two sheets forming the container body. Alternatively, the weak seal portion may be formed by heat seal the two sheets together with a multi-layer insert film held therebetween. FIG. 10 shows a modification wherein two-layer insert film is used. Indicated at 3 is a container forming film which is a single-layer or multi-layer film, at 18 is a sheet having a high heat seal strength on the innermost layer of the film 3 at one side, and at 19 is a sheet having a low heat seal strength on the innermost layer of the film 3 on the other side. The film portion 3 and the sheet 19 form a weak seal portions 21*a*, 21*b*. For example, when the film 3 is a single-layer film of PE or PP, the sheet 18 is made of the same material as the film 3, i.e., PE or PP, and the sheet 19 is made of a blend of PE and PP. Two insert films can be used which are each provided for the two weak seal portions respectively. The cover 5 may be heat-sealed in register with the weak seal portion provided that the weak seal portion is held weak, alternatively, the cover can be attached to the container body using an adhesive or the like.

The container of the invention is preferably stored or transported as folded in two at the weak seal portions 8*a*, 8*b* and as enclosed with an outer bag 50. When folded in two in this case, the seal portion is prevented from opening due to a pressure under the weight of superimposed containers or due to impact on falling.

Figure 12:
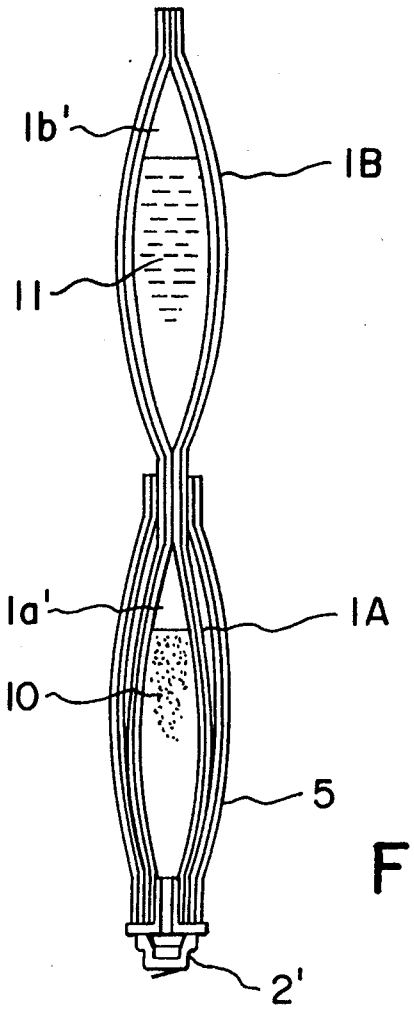
FIG. 12 shows a vertical section of the container according to a further embodiment of the invention.
Figure 11:
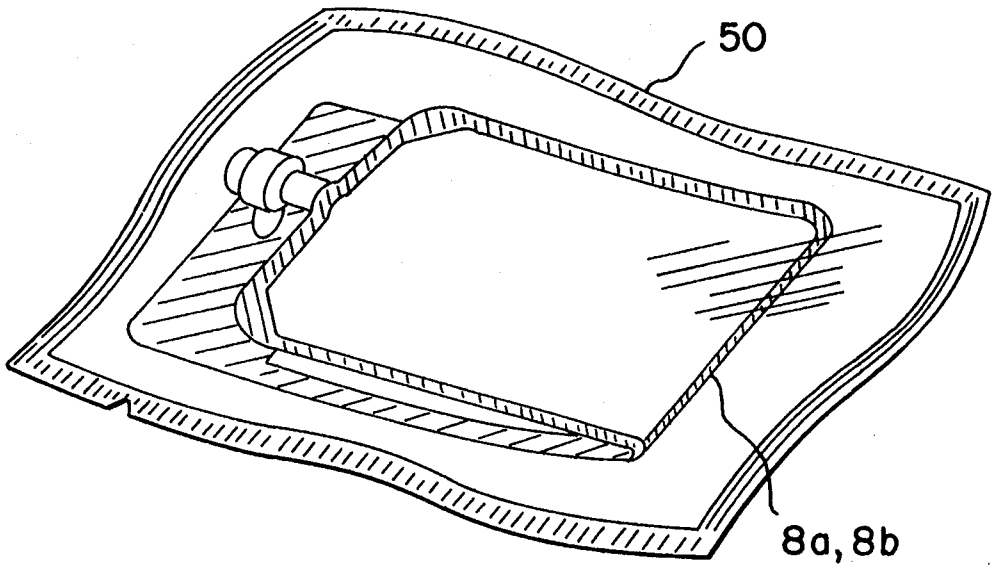
FIG. 11 is a perspective view of the container of the invention as enclosed with an outer bag for storage or transportation.

As shown in FIG. 12, the discharging port 2' may be formed at one end the chamber 1*a'* which contains a powder preparation 10 such as antibiotic. In this case, the chamber 1*b'* containing a liquid such as a dissolving solution is closed. If a discharging port is formed at a chamber containing a liquid such as dissolving solution, there is a risk of inadvertently administering only the liquid without mixing with the powder preparation especially in an emergency. Such risk can be eliminated by forming the discharging port at the chamber containing the powder preparation such as antibiotic.

Another preferred process for producing the container of the invention is described below with reference to FIGS. 13, (*a*) to (*j*).

Figures 13A, 13B, 13C, 13D, 13E, 13F, 13G, 13H, 13I, 13J:
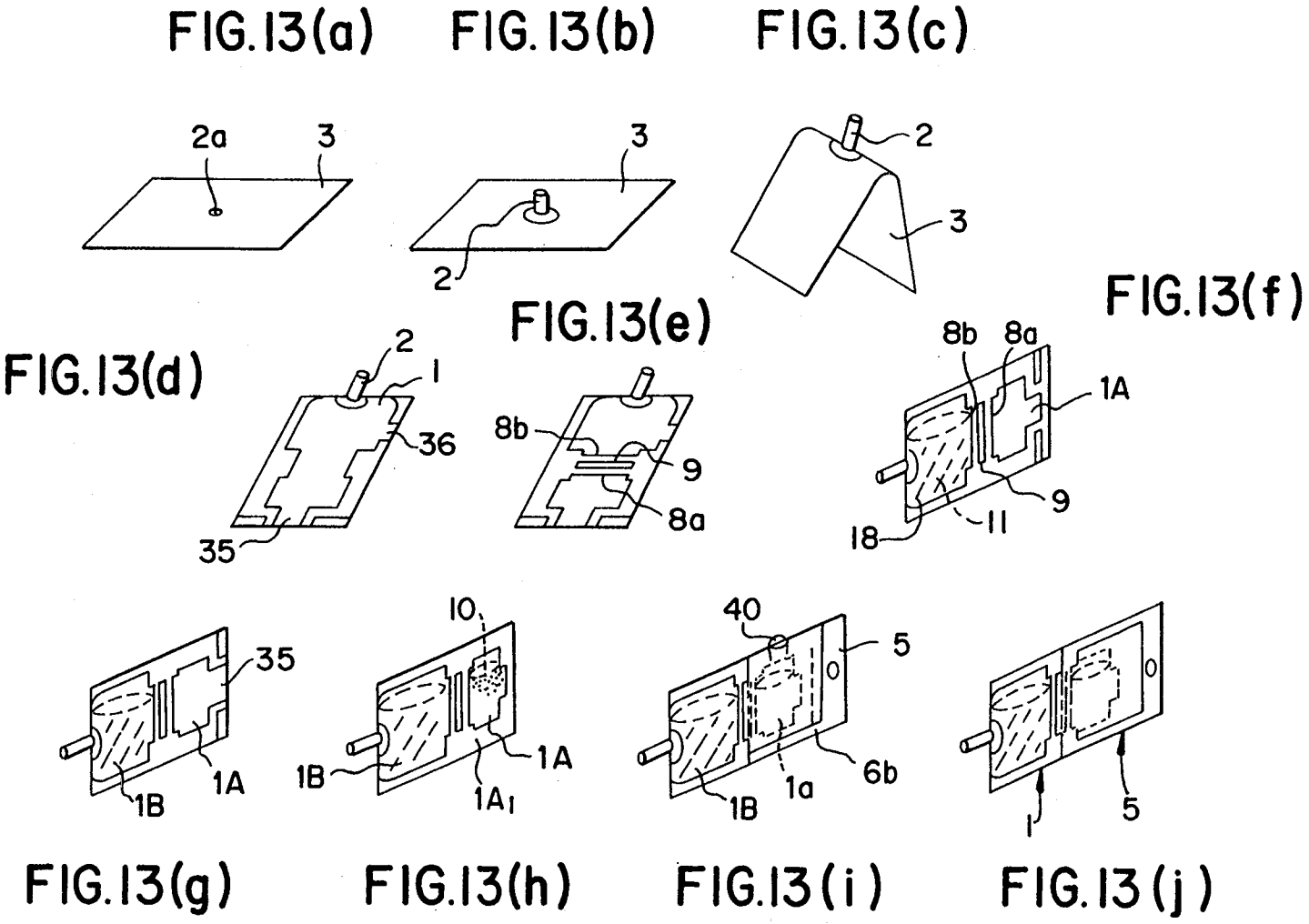
FIGS. 13 (*a–j*) is a diagram illustrating stepwise another preferred example of process for producing the container of the invention.

As shown in FIG. 13, (*a*), a discharge port hole 2*a* is formed in a two-layer plastics film 3 like the one shown in FIG. 3.

Next as seen in FIG. 13, (*b*), a discharge port 2 is attached by heat seal to the outer layer, i.e., the PE layer, of the film 3 in register with the hole 2*a*. The film 3 is then folded in two along a line through the discharge port 2 as shown in FIG. 13, (*c*).

Subsequently as seen in FIG. 13, (*d*), the two flaps of film 3 are heat sealed together at their peripheral portions at a temperature of about 170° to about 200° C. except at filling openings 35, 36 for a medicinal preparation and powder preparation to obtain a plastic container body 1. The filling opening 35 may be sealed and the filling opening 36 only may be left unsealed.

Next as shown in FIG. 13, (*e*), two parallel weak seal portions 8*a*, 8*b* are formed at an intermediate portion of the container body, with a space portion 9 provided therebetween, at a heat sealing temperature of about 110° to about 130° C. To be suitable, the weak seal portion 8*b* is 10 mm and the weak seal portion 8*a* is about 5 mm in width.

Consequently, upper and lower container portions 1A, 1B are formed as partitioned by the weak seal portions 8*a*, 8*b*. The medicinal preparation 11 is subsequently filled into the lower container portion 1B through the opening 36, and the two filling openings 35, 36 are thereafter sealed off as seen in FIG. 13, (*f*), followed by sterilization with autoclave.

Next as seen in FIG. 13, (*g*), the sterilized body is externally dried, the portion of the opening 35 is cut in an aseptic atmosphere to open the opening 35 again, and clean air is applied to the interior of the upper container portion 1A through the opening 35 for drying and cleaning.

Next as shown in FIG. 13, (*h*), the powder preparation 10 is filled into the upper container portion 1A through the opening 35 under an aseptic condition, and the filling opening 35 is thereafter sealed off.

Next as shown in FIG. 13, (*i*), a cover 5 is provided to enclose the upper container portion 1A therewith using two sheets of special film 6 shown in FIG. 5. Preferably one of the two film sheets is transparent, and the other sheet is nontransparent.

To render the filled preparation 10 substantially free from heat when the film 6 is heat sealed to the edge of the upper container portion 1A, it is preferable to provide a spacing of about 5 mm between the sealed joint 6*b* of the film 6 and the chamber 1*a* in the upper container portion 1A. For this purpose, the joint $1A_1$ (see FIG. 13, (*h*)) of the periphery of the upper container portion 1A, especially at opposite side portions thereof, needs to have a width greater than 5 mm. Usually this width is about 7 to about 10 mm in view of the sealing width of the film 6.

As shown in FIG. 4, the lower edge portion 6*c* of the cover 5 is sealed at the position of the space portion 9 between the two weak seal portions 8*a*, 8*b*. The sealing temperature is about 150° to about 170° C. when the film 6 used is transparent, or 130° to 150° C. when the film used is a nontransparent aluminum-covered film.

As seen in FIG. 13, (*i*), the cover 5 provided around the upper container portion 1A is initially partly open at one side thereof as indicated at 40. An inert gas or dry gas is injected into the space 7 between the cover 5 and the upper container portion 1A through the opening 40, and the opening 40 is thereafter sealed off. FIG. 13, (*j*) shows the container of the invention having the two chambers and two weak seal portions thus obtained. With the foregoing embodiment, the heat sealing temperature for forming each joint is selectively set to an optimum temperature range in accordance with the material of the film concerned and the contemplated seal strength. Accordingly, the sealing temperature ranges given above are in no way limitative.

Although the present invention has been described above with reference to several embodiments, the invention is in no way limited to these embodiments but can of course be practiced in various modes within the scope of the invention.

We claim:

1. A container having a plurality of chambers for accommodating a liquid, powder or solid and partition means dividing the container into the chambers and permitting communication between the chambers when required, the container being characterized in that the container comprises a flexible plastics container body forming the plurality of chambers, at least one of the chambers being enclosed with a cover having a sealed periphery to form a closed space therein around the chamber, the other chamber or chambers being coverless, the cover being made of a flexible film having moisture- and gas-barrier properties, the partition means being formed by at least one weak seal portion easily openable by pressing the chamber to give an increased internal pressure.

2. A container as defined in claim 1 wherein at least two weak seal portions are provided at a spacing, and the cover has a heat-sealed edge between the adjacent weak seal portions.

3. A container as defined in claim 1 wherein an inert gas or dry gas is enclosed in the closed space within the cover around the container body.

4. A container as defined in claim 1 wherein the covered chamber has accommodated therein a liquid, powder or solid susceptible to oxidation and/or hydgroscopic.

5. A container as defined in claim 1 wherein the weak seal portion or portions are formed by directly heat-sealing together opposed inner surfaces of a flexible plastics film forming the container body.

6. A container as defined in claim 1 wherein the weak seal portion or portions are formed by heat-sealing together opposed inner surfaces of a flexible plastics film forming the container body, with an insert film held between the opposed inner surfaces.

7. A container as defined in claim 1 wherein the container body is formed of a flexible plastics film comprising an outer layer of linear low-density polyethylene, an intermediate layer of resin mixture of linear low-density polyethylene and ethylene/$\alpha$-olefin elastomer, and an inner layer of resin mixture of linear low-density polyethylene and polypropylene.

8. A container as defined in claim 1 wherein the cover comprises a layer of silica-deposited resin film.

9. A container as defined in claim 1 wherein the cover comprises an outer layer of biaxially oriented polyethylene terephthalate film, an intermediate layer of silica-deposited polyvinyl alcohol film, and an inner layer of low-density polyethylene.

10. A container as defined in claim 1 wherein the cover has an outer surface provided by an aluminum-laminated film.

11. A container as defined in claim 4 wherein the substance susceptible to oxidation and/or hygroscopic is an antibiotic.

* * * * *